United States Patent [19]

Childree

[11] 3,985,494

[45] Oct. 12, 1976

[54] WASTE GAS BURNER ASSEMBLY

[75] Inventor: Herman Travis Childree, Tyler, Tex.

[73] Assignee: Howe-Baker Engineers, Inc., Tyler, Tex.

[22] Filed: June 26, 1975

[21] Appl. No.: 590,503

[52] U.S. Cl. ..... 431/175; 431/5; 431/285; 431/202

[51] Int. Cl.[2] ..... F23C 5/28

[58] Field of Search ..... 431/5, 8, 9, 174, 175, 431/284, 285 X, 202 X; 239/419, 423, 424, DIG. 7; 23/277 C

[56] References Cited

UNITED STATES PATENTS

| | | | |
|---|---|---|---|
| 2,879,862 | 3/1959 | Burden | 431/5 |
| 3,033,273 | 5/1962 | Zink et al. | 431/174 |
| 3,709,654 | 1/1973 | Desty et al. | 431/284 |
| 3,828,700 | 8/1974 | Ragot | 431/5 X |
| 3,837,813 | 9/1974 | Ebeling | 23/277 C |

*Primary Examiner*—Edward G. Favors

*Attorney, Agent, or Firm*—Dennison, Dennison, Meserole & Pollack

[57] ABSTRACT

Means and method for burning gaseous waste mixtures utilizing multiple ejectors for the jet introduction of fuel gas and the induction of waste gas for mixing therewith prior to discharge into the combustion chamber. The combustion chamber has a low pressure zone defined therein at the point of introduction of the fuel mixture for a spreading and stabilization of the flame front. The introduced mixture also induces combustion air flow and generates turbulence to effect efficient combustion.

9 Claims, 5 Drawing Figures

WASTE GAS BURNER ASSEMBLY

BACKGROUND OF THE INVENTION

This invention relates to a waste gas burning apparatus utilizing a novel method that makes use of the kinetic energy in a high velocity gas jet to induce the waste gas through the effect of a simple ejector. Multiple ejector stages are employed and are terminated within a ceramic lined combustion chamber. These ejector stages discharge into the chamber at a suitable angle in order to provide an impingement area that produces turbulence and also provides kinetic energy to induce the primary combustion air. Furnace draft provides additional primary air as well as secondary air by way of suitable openings.

Fuel shortages, economical operation of combustion hardware and environmental standards have caused industry to demand new combustion hardware and improved techniques. In order to fulfill these demands, the burner industry has attempted to modify existing hardware with only minor success. These attempts are in effect a stop-gap measure in an attempt to fulfill those new standards of operation while research and development is in process to produce the specific hardware needed. Heretofore, attempts involved injecting the waste gas into an established flame front with no means provided to achieve adequate mixing. This approach produced a form of reaction that, although the resulting flame pattern was useable, was not very successful.

An alternate method used the injection of the waste gas into the diffuser section of an inspirator. This provided a form of mixing but would not induce the proper amount of primary air nor provide adequate turbulence to produce the most efficient combustion.

Generally, a waste gas is at a very low pressure and therefore does not have adequate energy to induce suitable primary combustion air nor to generate the necessary turbulence to sustain a flame front. It is therefore necessary to provide a device that has the capability of providing those specific configurations and methods that will result in an improved combustion apparatus.

SUMMARY OF THE INVENTION

The principal objectives of this invention are to provide an improved means of burning volatile gaseous waste products that results in greater efficiencies, improved fuel economy and elimination of exhaust products that are deleterious to the environment.

The device of the present invention was developed to operate with a gaseous primary fuel such as natural gas, propane or butane and a low pressure waste gas having the following approximate analyses:

| | |
|---|---|
| Methane | 8.8% |
| Hydrogen | 48.3% |
| Carbon Monoxide | 3.7% |
| Carbon Dioxide | 38.4% |
| Water | 0.8% |
| | 100.0% |

While the device as disclosed herein was developed for a waste gas having the aforementioned components, it is not so limited and other gaseous components may be used with equal success. Extensive documented operational data has established that the device of the present invention provides excellent results with control capabilities which enable a large turndown ratio, efficient radiant duty with superior furnace temperature control and repeatability. Visual inspections of a typical flame pattern from an assembly providing a heat release of 8 million BTU per hour indicated a flame pattern of approximately 30 inches in diameter and 12 to 15 feet long. The flame shape showed no appreciable change as the waste gas was admitted to the device, however the flame color did change to violet; rendering it transparent and difficult to see within the furnace.

The novel device as disclosed herein was developed around an operating scheme which used a gaseous fuel as a startup means and injected the process waste gas into the device as an economizer. The waste gas heat content provides a fixed amount of heat release into the furnace and the fuel gas is varied to provide the required furnace temperature.

Therefore, it is an object of this invention to provide an improved burner apparatus for waste gas disposal.

A further object of this invention is to use the kinetic energy of the fuel gas to induce the primary combustion air.

Still another object of the invention is to use the kinetic energy of the fuel jet to induce the waste gas.

A still further object is to direct the fuel gas into a restricted throat so that multiple ejectors can be used with greater efficiency.

Another object of the invention is to use the ejectors in such a manner as to insure that the fuel gas and waste gas are thoroughly mixed before entry into the combustor section.

Likewise an additional object of the invention is to provide an air cooled metallic combustion chamber.

The above and other objects and novel features of the invention will become readily apparent from the following descriptions and accompanying drawings, wherein:

DESCRIPTION OF THE EMBODIMENT

Figure 1:
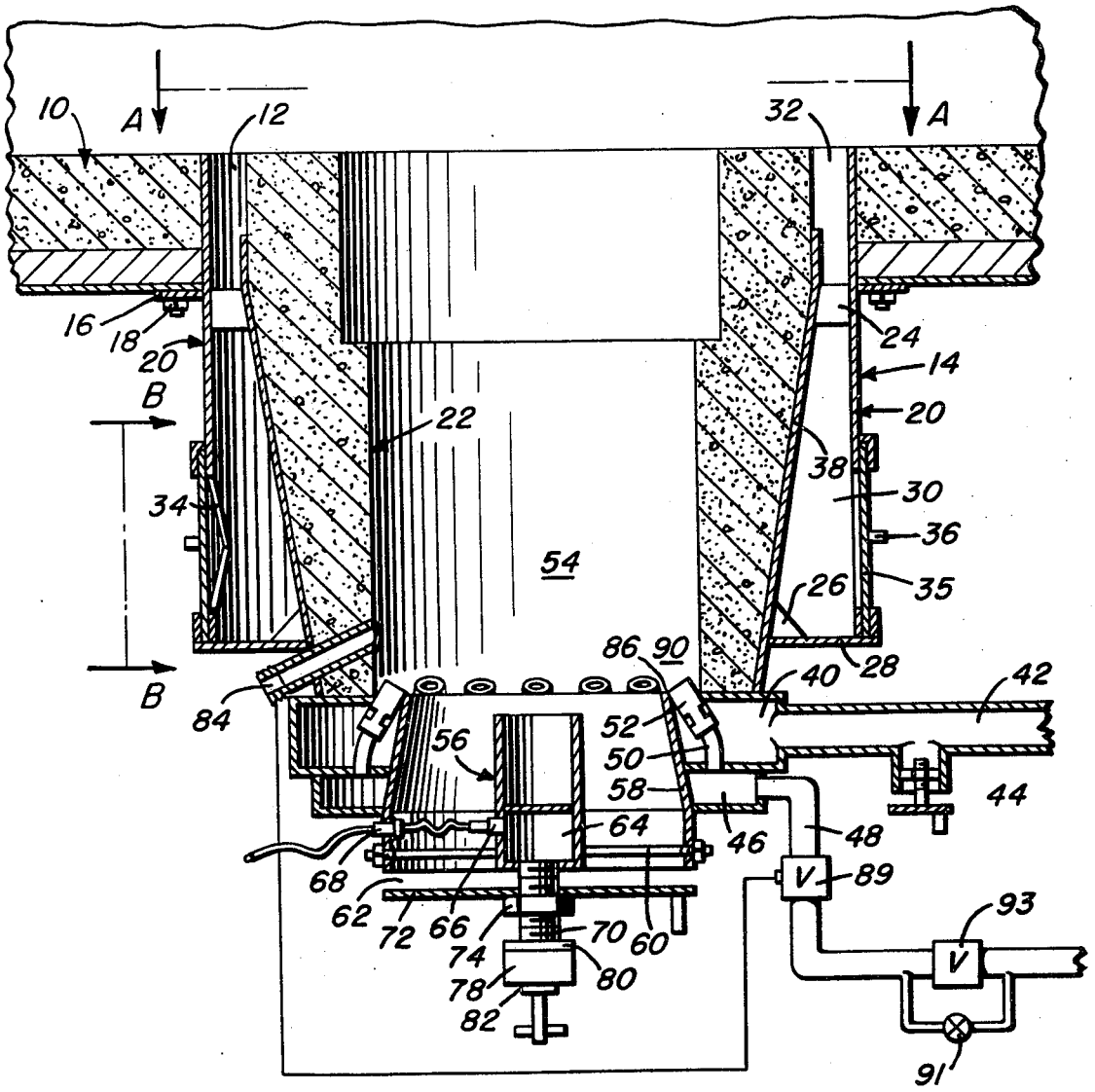
FIG. 1 is a cross sectional view of a preferred embodiment of the invention.
Figure 2:
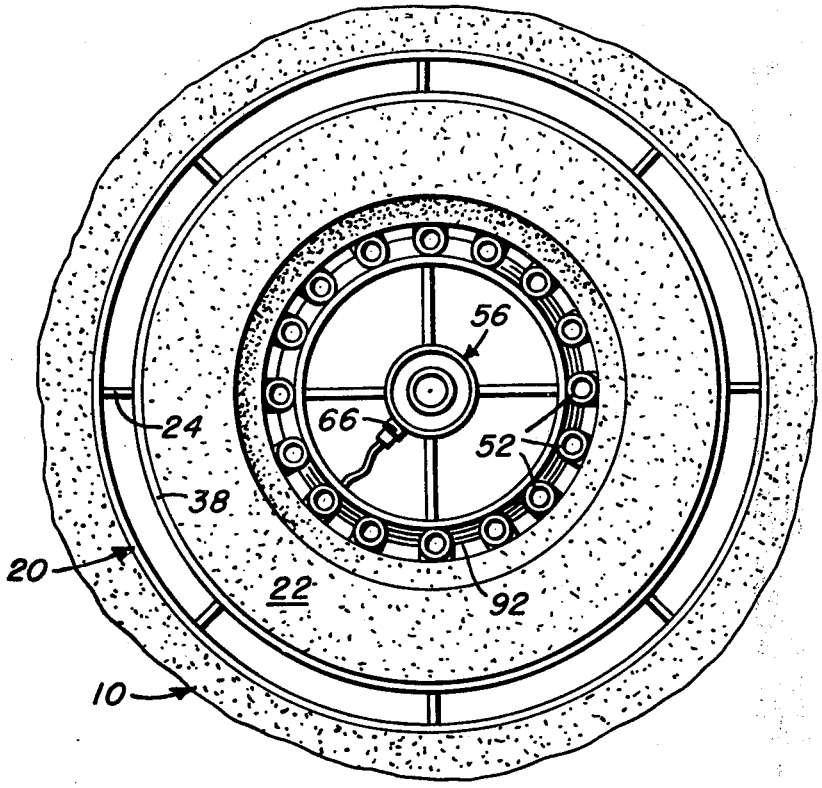
FIG. 2 is a plan view taken along lines A-A of FIG. 1.

Referring now to the drawings and particularly to FIGS. 1 and 2, there is illustrated an embodiment of the burner assembly for carrying out the objects of the invention wherein a conventional furnace floor 10 has provided therein an opening 12 for the reception of a burner assembly 14. Burner assembly 14 includes conventional means for attachment in floor opening 12, such as flange 16 having provision for reception and securement of threaded studs and locknut 18, flange 16 being integrally secured to support member 20 extending through floor 10. Spaced inwardly from support 20 is a ceramic combustor block 22 of substantially inverted frustoconical shape, positioned within support 20 by open spacer and expansion saddle 24 adjacent its upper end and by support gusset 26 and support plate 28 adjacent its lower (inlet) end.

The plenum 30 defined by the support member 20 and combustor block 22 forms a secondary air passageway around the combustor block and opens into the furnace via annulus 32. This plenum is provided with triangular openings 34, the flow through which may be manually adjustable by an outer sliding panel 35 having a rectangular opening 37 therein and an adjusting bar 36, thus controlling the flow of secondary air.

The ceramic block 22 may preferably have a metal shell 38 therearound. The inlet end of the combustor block 22 has attached thereto waste gas manifold 40 which communicates with a waste gas supply through conduit 42, which conduit may have a valve 44 for admission of primary air during startup. A fuel gas manifold 46 having a supply conduit 48 has provided therein a fuel tube and nozzle 50 which in turn communicates with an ejector 52 opening on one end into combustion chamber 54 and having provision therein for communication with waste gas manifold 40 so that injection of fuel into ejector 52 causes waste gas to be inspirated therein as well. Centrally positioned within the circular manifolds 40 and 46 is pilot assembly 56 which may be secured to depending skirt 58 of the manifold assembly by means of support rod 60. The primary air inlet 62 is formed about the pilot assembly. Pilot assembly 56 may comprise pilot burner portion 64 having connecting means for spark plug 66 which is extended through skirt 58 via insulator 68 to a source of high voltage. Threaded pilot gas conduit 70 depends from burner tip 64 and has, movably affixed thereto, primary air register plate 72 positioned by locking nut 74, the air register plate 72 and skirt 58 defining the annular inlet 62 therebetween. Pilot air register collar 78 and locking nut 80 form pilot air inlet 82 through which the pilot gas inlet conduit 70 extends. Flame scanner tube 84 may, of course, be mounted on the combustion block in the normal manner.

In describing the basic operation of the device, it is assumed that certain aspects of the installation are complete. For instance, it is assumed that the burner assembly 14 is attached to a suitable furnace floor 10 by use of the mounting flange 16 and securing studs 18. Likewise, the waste gas is connected to inlet 42, fuel gas is piped from a source to inlet 48, pilot gas is connected to the inlet of conduit 70 and a flame scanner 84 is mounted and properly orientated to sense the flame. It is finally assumed that a conventional control system, schematically shown in FIG. 1, is an integral part of the installation and where remarks concerning a control function are used, it is only as a method of describing the operation.

In operation, the secondary air register 34 is set one-half open by adjusting the register with handle 36. The primary air inlet 62 is set one-quarter open by rotating the register 72 and securing it by locking nut 74. Startup primary air valve 44 is opened.

Start switch (not shown) causes flow of pilot gas through conduit 70 and voltage to the spark plug 66. When pilot assembly 56 has established a flame, it is sensed by flame scanner 84 which causes the spark voltage from 66 to cease and establishes operating conditions for the main fuel safety control valve 89. The manual main fuel bypass valve 91 is opened to admit fuel gas into the fuel manifold 46 by way of the supply conduit 48. The primary and secondary air are then adjusted until the burner assembly and all gas pressures have been set. The main fuel bypass valve 91 is then closed, the temperature control system set point is established, which set point is below the existing furnace temperature, and the main fuel control valve 93 is opened. As the furnace temperature set point is raised, the main fuel control will open applying a controlled amount of main fuel to the burner. This procedure is basically a standard method of starting a furnace whereby the furnace temperature is raised slowly to prevent thermal shock to the brick-work.

When the process waste gas is available for usage, startup primary air valve 44 is closed, allowing the ejectors 52 to establish a very low pressure. Waste gas control valve (not shown) is opened to admit the waste gas to the manifold 40 by way of the supply 42. The waste gas is pumped from the manifold 40 by the ejectors 52 as a result of the velocity of the fuel gas as it exhausts from fuel nozzles 50. The two gases mix in the ejectors and continue into the flame front previously established within the combustor section 54. As the furnace temperature is reached, the fuel gas flow is adjusted to hold this condition, that is the waste gas is allowed to flow at a fixed rate and the fuel gas is modulated to control the furnace temperature.

It will be noted that the ejectors 52 and fuel gas jets 50 are angled from the vertical. The angle used in the development and documentation of the preferred embodiment of the device was 30 degrees, however this does not preclude the use of other angles. This angled flow primarily provides turbulence to sustain the flame front within the combustor section 54. A secondary purpose of the angled flow is to more efficiently induce primary air through the primary air register 62. It is necessary to mention that the furnace draft itself is used to assist in supplying the necessary combustor air. In order to establish the necessary excess air and to make up any deficient primary air, secondary air is admitted to the furnace by way of the secondary air registers 34. This secondary air flow enters the furnace by way of the annulus 32 formed between the burner 14 and the furnace floor 10. This secondary air flow thus surrounds the flame exhausting from the burner 14 and slowly mixes with the flame to effect a semiluminous to luminous flame. It is important that the turbulence be controlled at a condition which sustains the flame front but does not greatly affect the mixing that would nullify the reaction required for a radiant duty flame.

Figure 3:
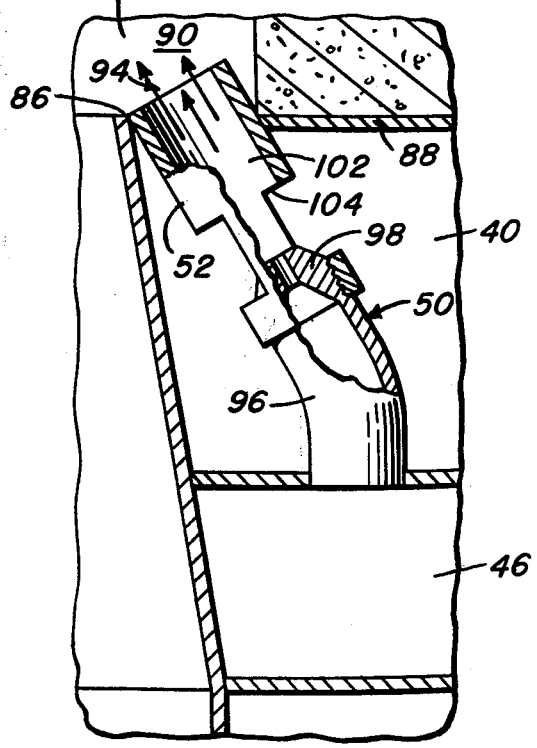
FIG. 3 is a partial sectional view in elevation illustrating the fuel nozzle ejector assembly in the preferred arrangement.

FIG. 3 is an enlarged view in section of a typical ejector station, 50–52 of FIGS. 1 and 2. The number of such stations to be used is based on the required heat release of the burner assembly and may be readily calculated by one skilled in the art. It is necessary to point out that a step 86 is formed by a stabilizing ring 92 defined by the inwardly projecting portion of the ejector installation plate 88. This ring 92 serves as a flame holder or stabilizing means for the flame front. The low pressure zone 90 formed immediately above the stabilizing ring 92 by the kinetic energy of the gas and primary air flow assists in causing the flame to be evenly distributed across the combustor section by pulling the flame front back.

It will be noted that the fuel tube 50, which comprises tube 96 having integral nozzle 98, is attached to the ejector body 52 by threads. This is a preferred method to insure that the nozzle centerline remains on the ejector centerline during assembly. Likewise this method insures that the nozzle exit and the ejector inlet are kept at the proper distance.

The basic operation may again be described as follows. As the fuel gas enters the manifold 46, it is caused to enter the fuel tube 96. This fuel flow becomes sonic at fuel nozzle 98 when the design specific pressure ratio is reached. This sonic flow then enters the inlet of the ejector 52, shocks down, and flows through the ejector throat 102 and finally is discharged into the low pressure zone 90 of combustor section 54 along flow lines 94. The effect of the sonic fuel gas flow and the kinetic energy thereof causes pumping or ejecting of the atmosphere within the waste gas manifold 40. Therefore, when the waste gas is admitted to this manifold 40, it is pumped into ejector throat 102 through slots 104 by the effect of the ejector action. The flows within the ejector 52 insure adequate and efficient mixing of the fuel and waste gases. The sizing of the ejector is controlled by the pressures available and ejector minimum velocity to assure that the exhaust velocity is much greater than the flame spread of the mixture. Only a simple ejector design has been used in this preferred embodiment, but this does not preclude the use of other designs with equal success. The sonic velocity at the fuel tube nozzle 98 is, of course, calculated in the design stage and determined by the critical pressure ratio. Any change in weight flow of the gases being employed must then be compensated for by changing or varying pressure.

Although the angle of entry of ejector 52 is not critical, the preferred range is from about 15° to 45°, the shallower (lesser) the angle, the longer the flame and consequently the combustion chamber. It has been found that at about 45°, the combustion chamber must be about 1½ diameters, and at 15°, about 4 diameters.

Figure 4:
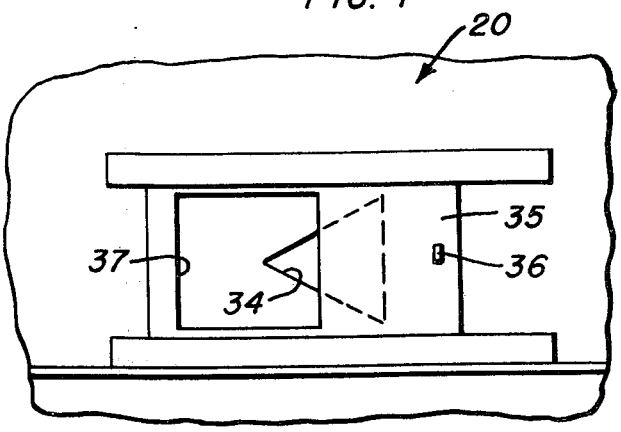
FIG. 4 is a side elevational view of the secondary air register taken along lines B—B of FIG. 1.

FIG. 4 illustrates a preferred embodiment of the secondary air register used in the invention wherein the openings 34 are triangular to enable very close control of the flow. Basically, the outer member 35 is movable relative to the support member 20 and has a square opening 37 so that as it is moved across the triangular opening 34, the relative size of the opening increases or decreases in relation to the area of the triangular opening. This permits very fine adjustments that are not achievable utilizing normal furnace registers. Incidentally, it will be appreciated that the size of the outer square openings 37 is such so as to enable a complete opening of the corresponding triangular openings 34.

In large vertical furnaces the amount of draft varies over its length. That is to say, when the stack damper is used to control the draft pressure there can be a negative pressure at the bottom of the furnace and a positive pressure at the top of the furnace. In applications where the stack gases are used to operate a specific heat exchanger, an additional burner assembly at the stack base to boost the heat release in the stack under certain conditions is generally required. A positive pressure in the stack generates problems with the booster burner assembly as well as causing burnouts of the hardware when the hot gas in the stack exhausts from the openings at the stack base.

The disclosed method of controlling the secondary air flow makes possible an alternate means of controlling the furnace draft by the secondary air shutter on the burner assembly at the bottom of the furnace. To describe this operation it must be assumed that a suitable operator means is attached to the register operating bar 36 and an automatic furnace draft control (not shown) is installed and connected to the operator. If we assume that the draft requirement is 0.3 inches of water and the draft control unit has been set for this amount, the air shutter would normally be closed on a cold furnace. As the furnace begins to heat and the thermal lift of the hot gas leaving the furnace lowers the pressure within the furnace, the air register would begin to open, allowing the secondary air to enter the furnace in order to maintain the negative pressure or draft at the controlled set point. Because the draft control is at the bottom of the furnace, there is no restriction in the furnace exhaust system, therefore less chance for a positive pressure buildup within the furnace top.

Figure 5:
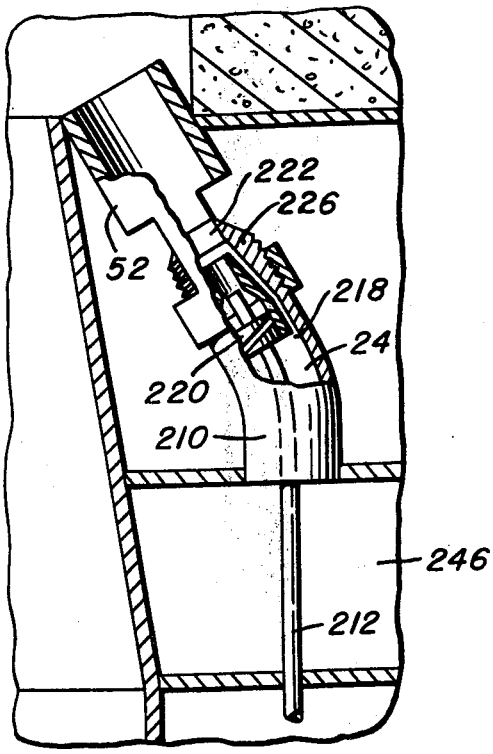
FIG. 5 is a partial sectional elevation similar to FIG. 3 but showing an embodiment for use of a liquid fuel.

FIG. 5 is illustrative of another embodiment of the ejector disclosed in the preferred embodiment of the invention, wherein the burner may utilize an oil-steam or oil-air fuel. In this embodiment, the cyclonic, multifuel nozzle of copending application Ser. No. 447,613, filed Mar. 4, 1974, now U.S. Pat. No. 3,897,200 is used in place of fuel gas nozzle 98. In this instance, tube 210 communicates with steam or air manifold 246 and incorporates fuel oil conduit 212, which of course is in communication with a liquid fuel source. Tube 210 thus comprises an atomizing medium conduit 214, this conduit terminating in an atomizing head 216 having impingement passages 218, vortex generating plate 220 and exit nozzle 222. As fully documented in the reference application, the atomizing medium is induced to form a vortex which atomizes the fuel flowing from tube 212, the droplets of which are further acted upon by the atomizing medium exiting from impingement openings 218. Once atomized by head 216, the fuel-air or fuel-steam passes nozzle exit 222 and flows through ejector 52 in the same manner as above described.

It will thus be apparent that the present device accomplishes results not before achieved in burner design, among these being the more thorough and efficient mixing in the ejector while retaining a simple and economical design; the inspiration of the relatively unpressured waste gas; and the demand supply of the primary combustion air responsive to the fuel/waste gas injection making primary air self-compensating through weight-flow response; while at the same time, and interdependent on the ejector mechanism, establishing and controlling the flame front and enhancing efficient mixing through employment of the stabilizer step which establishes a low pressure zone.

Although particular embodiments of the invention have been illustrated and described, changes and modifications will become apparent to those skilled in the art and the appended claims are intended to encompass all such changes and modifications as come within the true spirit and scope of the invention.

I claim:

1. A burner assembly for the utilization of a secondary fuel comprising: a combustor section including an outlet end adapted for installation to a furnace and an inlet end for cooperative attachment to primary and secondary fuel sources and igniter and burner means; primary fuel supply means including, in part, plural high velocity fuel nozzles, secondary fuel supply means; a constricted section on the inlet end of said combustor section establishing a low pressure zone extending around the periphery and inward of said combustor section inlet end; said constricted section having means therein for introducing fuel into said combustor section in the low pressure zone established by said constricted section; said high velocity fuel nozzles discharging into and through said fuel introducing means, said secondary fuel supply means communicating with said fuel introducing means and responsive to the high velocity fuel nozzle flow for ingestion of secondary fuel from said secondary fuel supply means into said fuel introducing means, the primary and secondary fuels thus being caused to intimately mix within and by said fuel introducing means; means in communication with said combustor section for the introduction thereinto of primary combustion air, said air introduction means having an operative relationship to said combustor section and said fuel introducing means and said constricted section so that said primary combustion air is directly responsive to the discharge from said fuel introducing means; said constricted section being defined by a skirt generally coaxial with the inlet end of the combustor section and laterally offset inward thereof so as to define an outwardly offset step between the skirt and the inner wall of the combustor section, said low pressure zone being established immediately above the step, said means for introducing fuel into said combustor section discharging upward through said step, said means for introduction of primary combustion air communicating with said combustor section through the internal area defined by said skirt, said secondary fuel supply means comprising a manifold defined immediately below said step, said fuel introducing means having an inlet section communicating with the interior of said manifold, a secondary fuel supplying conduit communicating with said manifold, said primary fuel supply means comprising a second manifold adjacent said first mentioned manifold and a primary fuel supplying conduit communicated with said second manifold, said high velocity fuel nozzles, in each instance, communicating with the inlet section of the fuel introducing means within the first manifold, and a fuel tube communicating each nozzle with said second manifold.

2. The burner assembly of claim 1 including a pilot assembly mounted centrally within said skirt with the primary combustion air introduction means orientated circumferentially thereabout.

3. The burner assembly of claim 2 including secondary combustion air introduction means surrounding said combustor section and including means adapted for communication thereof with a furnace about the outlet end of the combustor section.

4. The burner assembly of claim 3 including means for regulating the flow of air through said primary combustion air introduction means, and means for regulating the flow of air through the secondary combustion air introduction means.

5. The burner assembly of claim 4 wherein said secondary combustion air introduction means includes an air register defined by a first triangular opening and an overlying adjustable plate having a rectangular opening therein selectively movable relative to the triangular opening for varying the exposed area of said triangular opening.

6. A burner assembly comprising: a combustor section adapted for installation in a furnace; means for supplying a primary fuel; means for supplying a secondary fuel; primary fuel injection and atomization means in operative communication with said primary fuel supply means; fuel mixing and ejector means in open communication with said secondary fuel supply means and in operative relationship to said primary fuel injection means for injection of the primary fuel into said mixing and ejector means and ejection therefrom, said fuel mixing and ejector means inspirating the secondary fuel in response to flow of the primary fuel, mixing the primary and secondary fuels, and ejecting the mixture into the combustion section, said fuel mixing and ejector means, in conjunction with flow of the primary fuel, constituting the sole means effecting a flow of the secondary fuel to and through the fuel mixing and ejector means into the combustion section; means constricting the inlet end of said combustion section and establishing a low pressure zone therearound, said mixing and ejector means ejecting into said low pressure zone; and primary combustion air inlet means communicating with said low pressure zone with movement of air therethrough being responsive to ejection of mixture thereinto.

7. A burner assembly for the utilization of a secondary fuel comprising: a combustor section including an outlet end adapted for installation to a furnace and an inlet end for cooperative attachment to primary and secondary fuel sources and igniter and burner means; primary fuel supply means including, in part, plural high velocity fuel nozzles; secondary fuel supply means; means for introducing fuel into said combustor section at the inlet end; said high velocity fuel nozzles discharging into and through said fuel introducing means, said secondary fuel supply means communicating with said fuel introducing means and responsive to the high velocity fuel nozzle flow for ingestion of secondary fuel from said secondary fuel supply means into said fuel introducing means, the primary and secondary fuels thus being caused to intimately mix within and by said fuel introducing means; means in communication with said combustor section for the introduction thereinto of primary combustion air; said secondary fuel supply means comprising a manifold defined immediately outward of said combustor section inlet end, said fuel introducing means having an inlet section communicating with the interior of said manifold, a secondary fuel supplying conduit communicating with said manifold, said primary fuel supply means comprising a second manifold adjacent said first mentioned manifold and a primary fuel supplying conduit communicated with said second manifold, said high velocity fuel nozzles, in each instance, communicating with the inlet section of the fuel introducing means within the first manifold, and a fuel tube communicating each nozzle with said second manifold.

8. The burner assembly of claim 7 including a pilot assembly mounted in axial alignment with the inlet end of said combustor section, said means for introduction of primary combustion air being orientated circumferentially about the pilot assembly, and secondary combustion air introduction means surrounding said combustor section and including means adapted for communication thereof with a furnace about the outlet end of the combustor section.

9. The burner assembly of claim 8 including a constricted section on the inlet end of said combustor section and a low pressure zone established by said constricted section and extending around the periphery and inward of said combustor section inlet end.

* * * * *